United States Patent [19]

Astrope et al.

[11] Patent Number: 4,964,752

[45] Date of Patent: Oct. 23, 1990

[54] METHOD AND APPARATUS USING BITUMINOUS SANDSTONE FOR PAVEMENT REPAIR

[76] Inventors: Myrle E. Astrope, 220 North 1300 East; Norman P. Bushman, 1213 East 50 North, both of Pleasant Grove, Utah 84062

[21] Appl. No.: 396,430

[22] Filed: Aug. 21, 1989

Related U.S. Application Data

[62] Division of Ser. No. 146,296, Jan. 20, 1988.

[51] Int. Cl.[5] ..... E01C 9/12

[52] U.S. Cl. ..... 404/92; 404/111; 427/139

[58] Field of Search ..... 404/92, 108, 111; 427/138, 139

[56] References Cited

U.S. PATENT DOCUMENTS 4,695,186 9/1987 King ..... 404/111

4,780,022 10/1988 Ohiba et al. ..... 404/92 X

*Primary Examiner*—William P. Neuder

*Attorney, Agent, or Firm*—Thorpe, North & Western

[57] ABSTRACT

A method, apparatus and material for filling or surfacing fissures, openings and cavities in a pavement surface. The method comprises the steps of preparing a volume of water, heated to a temperature of 110–210 degrees F, and mixing a given quantity of bituminous sandstone therein in a ratio of 20 to 56% water by weight. This mixture is continuously agitated to develop a slurry which is capable of being pumped through a conduit to the repair location or site. Apparatus is disclosed for preparing the subject slurry and for enabling a continuous repair operation within a self-contained system.

13 Claims, 5 Drawing Sheets

METHOD AND APPARATUS USING BITUMINOUS SANDSTONE FOR PAVEMENT REPAIR

This is a division of application Ser. No. 146,296 filed Jan. 20, 1988.

BACKGROUND OF THE INVENTION

1. Field of Invention

The present invention relates to a material used for repair and patching of pavement such as asphalt or cement. More particularly, the present invention pertains to a method and apparatus for applying a tar sand material as a filler and resurfacing substance useful on various pavement surfaces.

2. Prior Art

It is well known that pavement surfaces typically experience various forms of degradation, cracking, separation between sections and other forms of wear which require periodic maintenance. Such pavements include roads, parking lots and virtually any area experiencing traffic and which are subject to weathering conditions which tend to degrade and crack asphalt, cement and other paving materials.

Conventional repair materials for pavement resemble a tar-like substance which must be heated to approximately 400 degrees Fahrenheit and require the crack, opening or other degraded pavement section to be treated with a preliminary coat of base material to improve bonding of the filler, such as an asphalt or tar aggregate. In addition to the heating requirements of maintaining the base sealer and asphalt at high temperatures, application of the material requires an amiable climate in order to obtain satisfactory results.

It is common knowledge that most degradation of pavement surfaces occurs during winter where cold temperatures and moisture combine to break up asphalt due to freezing temperatures and the effects of moisture. Such wet pavements and subzero temperatures are generally not suitable for applying asphalt filler. It is not only difficult to establish the proper temperature under such conditions, but it imposes a greater expense. For this reason, road maintenance operations typically occur in the spring after all of the damage has been done. If repair could be effectually accomplished during actual times of more adverse winter conditions, damage would be less serious and less costly. Accordingly, a variety of repair materials have been developed which attempt to provide permanency as well as greater versatility for application during adverse weather conditions. To date, most of these materials have proven to be too expensive to merit broad commercial use.

In some parts of the country, such as UT, natural tar sand and asphalt deposits enable frequent repair of road damage. For example, in central Utah where large deposits of tar sands exist, roads are constructed utilizing this naturally occurring material. Therefore, when road damage occurs additional tar sand material is used to repair the holes or cracks without special processing or treatment. This naturally occurring material is difficult to work with, however, because it is typically extracted in aggregate chunks which are difficult to reduce to a uniform grain size. Some efforts have been made to soften the material by adding petroleum solvents; however, this appears to adversely affect the quality of the tar sands as a road filler. In its untreated form, tar sands are not effective in filling cracks and are unmanageable for other applications requiring a flowable character. It has not been deemed otherwise practical to liquify the tar sand composition except for processing in a fuel separation process where preservation of the pavement repair properties is immaterial.

Aside from its use as paving material, the primary application of tar sands or bituminous sandstone has been toward production of fossil fuels. Many processes have been developed for separating the bituminous material from mineral content and for treating the bitumen to refine its petroleum products. U.S. Pat. No. 3,556,981 by Cymdalisty and U.S. Pat. No. 4,236,995 by Kruyer are representative of tar sand separation processes. Cymdalisty illustrates one method involving separation of a slurry of bituminous sand and water which is introduced into a body of water so that the bitumen floats to the top and the sand settles to the bottom. Because of their immiscible nature, separation of the petroleum from water is naturally expected. Kruyer illustrates a mechanical system wherein steam and water are mixed with the tar sands in a tumbler and the resulting slurry is subject to separating processes for removing the bituminous components.

U.S. Pat. No. 3,331,765 by Canevari illustrates a separation process for treating athabasca tar sands, which are somewhat different from the Utah type tar sand materials. Many other patents can be cited showing a variety of separation techniques; however, such separation of petroleum from tar sands is not considered relevant to the present invention.

Other patents which discuss preparation of road surfacing compositions include U.S. Pat. No. 3,423,222 by McConnaugha and U.S. Pat. No. 2,068,164 by Cadwell. Each of these disclosures discusses the use of a bituminous material as a bonder for mixing with aggregate. The resulting product resembles asphalt material which is used for treating the road or for filling damaged road surfaces. These disclosures represent the typical process of fabricating a composition by combining biumen with aggregate material in various combinations. Unfortunately, such compositions have been inadequate as road repair material for reasons which have been previously set forth.

OBJECTS AND SUMMARY OF THE INVENTION

It is therefore an object of the present invention to provide a repair material which is suitable for application during cold and wet weather conditions, and which retains its bonding configuration with greater endurance than prior art asphalt materials.

It is a further object of the present invention to provide a composition which can be economically derived from existing bituminous sandstone by inexpensive treatment processes which develop durability and ease of application.

A still further object of the present invention is to provide a modern method o preparing the bituminous sandstone material, which can be readily practiced at the site of repair without the need of expensive equipment and processing procedures.

It is a further object of this invention to provide an apparatus which may be utilized at the location of repair for preparing the bituminous sandstone composition which can be used as pavement repair material.

Yet another object of this invention is to provide a material, method and apparatus for applying the material which does not require the higher temperatures practiced with prior road repair methods, thereby reducing cost and risk for those practicing the process.

These and other objects are realized in a method for repairing pavement surfaces which includes the steps of heating a given volume of water to a temperature of at least 110 degrees F. but not more than 210 degrees F., which temperature is maintained throughout the procedure. A given quantity of bituminous sandstone is then mixed with the water in a ratio in which the water comprises 20–56% by weight of the total mixture composition. This mixture is continuously agitated to develop a uniform slurry having a consistency and viscosity which enables the slurry to substantially fill, conform and bond to the interior surface of the repaired hole or pavement, yet which does not result in separation of the bitumen and water into separate phases. This material is then pumped or transported to the appropriate repair location for application.

The subject method is practiced in an apparatus which comprises a mobile platform or base with attached first and second chambers which are utilized respectively for heating the water and then mixing the water with bituminous sandstone to develop the desired slurry. Agitating means are provided in the second chamber to maintain the slurry consistency and also the desired temperature range between 110–210 degrees F. This apparatus includes some form of transport means such as a pump and conduit for conveying the slurry to the application site.

Other objects and features of the present invention will be apparent to those skilled in the art in view of the following detailed description, taken in combination with the accompanying drawings.

DETAILED DESCRIPTION OF THE INVENTION

Figure 1:
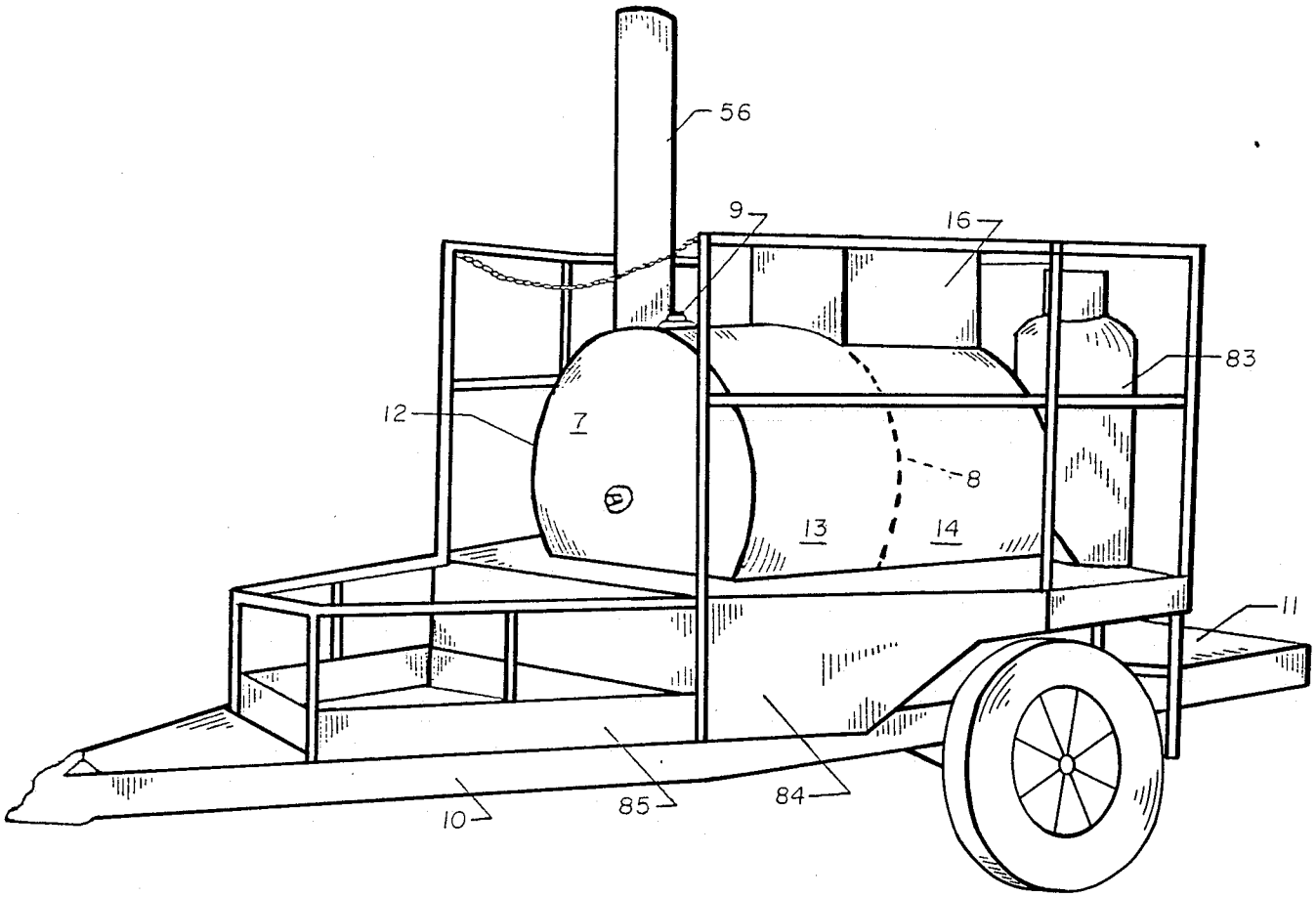
FIG. 1 shows a perspective view of one embodiment of an apparatus for applying the subject pavement repair material.

It has been discovered that bituminous sandstone can be processed within certain temperature and composition limitations to develop an unusually effective road repair material capable of application at temperatures almost one-half the prior art temperature range for road repair material. In addition, this material is capable of being applied in more adverse conditions such as rain or snow. It has the surprising ability to retain its ductile character, thereby enabling it to later repair itself when fragmented or deformed due to wear and tear. In other words, broken repair material of the present invention, when allowed to heat in sunlight, will repair itself to a renewed sealed and bonded form. This material requires no advance treatment of the road surface with sealer, and can be applied directly to the cavity, fissure or broken pavement area. Furthermore, its surface can be textured or otherwise treated to conform to the same surface appearance as the pavement being repaired. This applies whether the pavement is cement or asphalt. Such results are considered particularly unusual and surprising in view of the prior art perception that bituminous sandstone was subject to serious limitations as a road repair material. Such results are further unexpected in view of the acknowledged tendency of a slurry composition of bituminous sandstone and water to separate into respective mineral/water components. Equally surprising is the simplicity in which the slurry can be prepared in an inexpensive and versatile apparatus.

The materials suitable for application to this process are generally referred to as bituminous sandstone. Such material, also referred to as tar sands, contains variable amounts of bitumen in pore spaces between: the sand composite. As used herein, bitumen refers to native substances of variable color, hardness and volatility which are composed principally of hydrocarbons, substantially free from oxygenated bodies. Although other forms of tar sands may be suitable, it has been discovered that the particular tar sand composition found at the Asphalt Ridge area in Uintah County, UT, U.S.A. are particularly suitable for the present application. Such tar sands are characterized by the presence or absence of the following component elements i: the bitumen material:

| COMPONENT | PER CENT |
|---|---|
| Free asphaltous acid | 0 |
| Asphaltous and hydrides | 3.6 |
| Asphaltenes | 19 |
| Resins | 45 |
| Oily constituents | 31 |

It will be noted that water content is very low and the resin content of this particular bitumen is unusually high and possibly facilitates improved adherence and ductility. It is further believed that resin contents extending down to 30% would provide the necessary adherence properties which facilitate operatiOn of the slurry as a repair material and permit its preparation in accordance with the subject procedures. This material is characterized by a viscosity at 210 degrees F. within the range of approximately 15–37 poises (absolute) for the asphalt component recovered from such bitumen. These parameters were derived from studies relating to comparable asphalts and bitumen deposits as set forth in a Utah Geological and Mineralogical Survey entitled "Bituminous Sandstone Deposit: Asphalt Ridge," by Robert Kayser, Special Studies #19, 1966.

More particularly, it has been discovered that bituminous sandstone forms a surprisingly effective pavement repair material if maintained within a proper viscosity represented by a suitable percentage concentration of water and proper range of temperature. Specifically, if the bituminous sandstone is mixed with 20 to 56% water by weight and if the temperature of the mixture is maintained within the range of 110–210 degrees F., the material is capable of maintaining a slurry consistency which is suitable for application within cracks, fissures and openings of pavement to provide a properly repaired surface. The desired physical properties of this material are maintained provided the mixture is constantly agitated to maintain the desired consistency and uniform suspension of mineral material throughout the fluid binder comprising the bitumen, resins and other tar sand constituents.

Furthermore, it has been discovered that a mixture of bituminous sandstone and water wherein the percentage of water is 24 to 30% by weight, and in the most preferred embodiment 26% by weight, the mixture has excellent adhesive or bonding properties which enable it to quickly bond with the pavement material within the fissure or opening and retain this bond for extended periods beyond typical road repair materials.

These preferable conditions are only realized if in addition to proper water/tar sand mixture percentages, the material is maintained within the temperature range of 110–210 degrees F. Within this temperature range, the bitumen does not separate if properly agitated and does rot crystallize or experience other physical modification which adversely affects its ability to flow and bond within the crack or opening. If temperatures exceed approximately 210 degrees, the bitumen is adversely affected so that proper bonding and flowability characteristics are significantly impaired. The preferred range of temperatures for optimum performances appears to be in the general range of 150–180 degrees F.

The viscosity Of the asphalt component of this slurry mixture when properly balanced with water concentration and maintained at the identified temperatures falls within a general range of 20–50 poises (absolute) for Utah tar sands and 15–20 for California tar sand deposits for the asphalt component of the bitumen. The preferred viscosity is within the range of 30–40 poises.

The presence of at least 30% resin within the bitumen material appears to provide the necessary bonding properties to enable the material to solidify and retain its repaired state. Ideally, the material should be at least 40% resin by weight, with the optimum percentage being approximately 45%.

FIG. 1 provides an apparatus which is useful in preparing a slurry material having the foregoing properties. It consists of a base or platform 10 which includes wheels or other means for mobile use. The base is particularly suited for use as a trailer for carrying the subject apparatus to actual repair sites. The apparatus permits preparation of the subject slurry on site.

Figure 2:
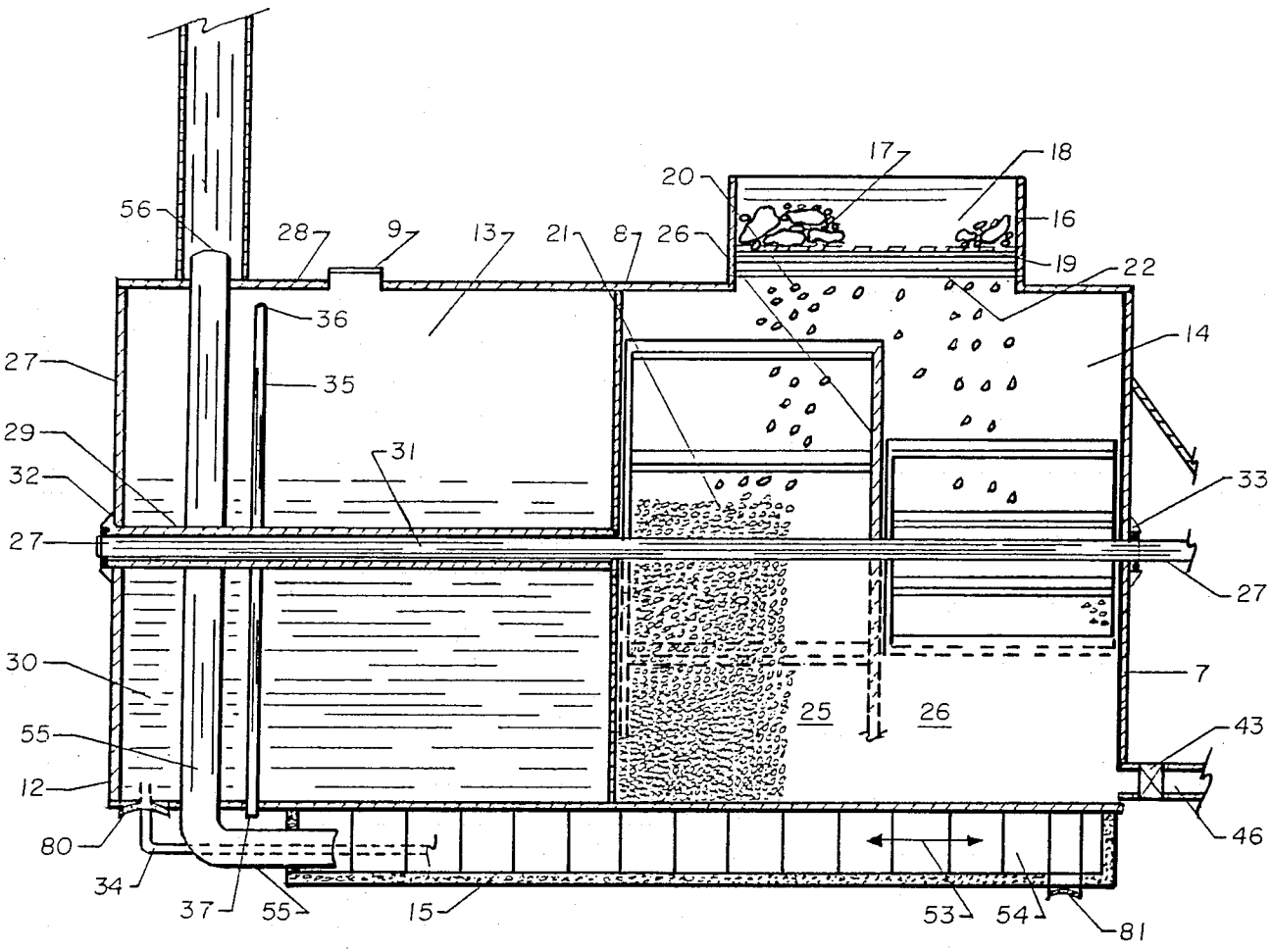
FIG. 2 shows a cross section view of the tank utilized to prepare the subject slurry composition, showing a portion of the tank filled with the bituminous sandstone.

The base 10 includes a top support surface 11 to which the various components of the apparatus are attached. These components include a tank 12 which is divided into a first chamber 13 and a second chamber 14. The first chamber 13 operates to contain water which is added to the tar sands to prepare the desired slurry. An inlet 9 is provided for introducing water into the first chamber 13. Means for heating the water within the first chamber is positioned below the tank at 12 as shown in FIG. 2. This heating means consists of a fire box 15 which extends along the lower surface of the tank 12. This heating means 15 is discussed in greater detail hereafter.

The second chamber is provided with an opening and hopper chamber 16 for receiving the lituminous sandstone. As is shown in FIG. 2, coarse tar sand material 17 is placed in the receiving chamber 18 of the hopper 16 and feeds through a grate or mesh 19 into the second chamber 14. The grate operates to size the tar sand aggregate 20 to appropriate dimensions of less than one inch in diameter. The particulate matter 21 represents the aggregate 20 in a slurry form, but is depicted in only the left portion of chamber 14 to enable a more clear description of other components within the chamber. The hopper 16 also includes splash guards 22 which channel the particulate matter 20 toward the center of the chamber and also prevent the slurry material 21 from splashing out of the chamber 14.

A plurality of rotating blades 25 are provided within the second chamber 14 to mix the water and bituminous sandstone into the desired slurry consistency. The illustrated blades comprise two-inch angle iron which are supported between projecting support arms 26 which are attached to a rotating shaft 27. Typical rotation rates for the shaft and attached blades 25 are at rates of less than 60 cycles per minute. The foregoing description of the apparatus 12 is intended to be general in nature. It is to be understood that the following more detailed description is merely exemplary of the preferred embodiment, and is not to be limiting as to the scope of invention claimed hereafter.

Figure 3:
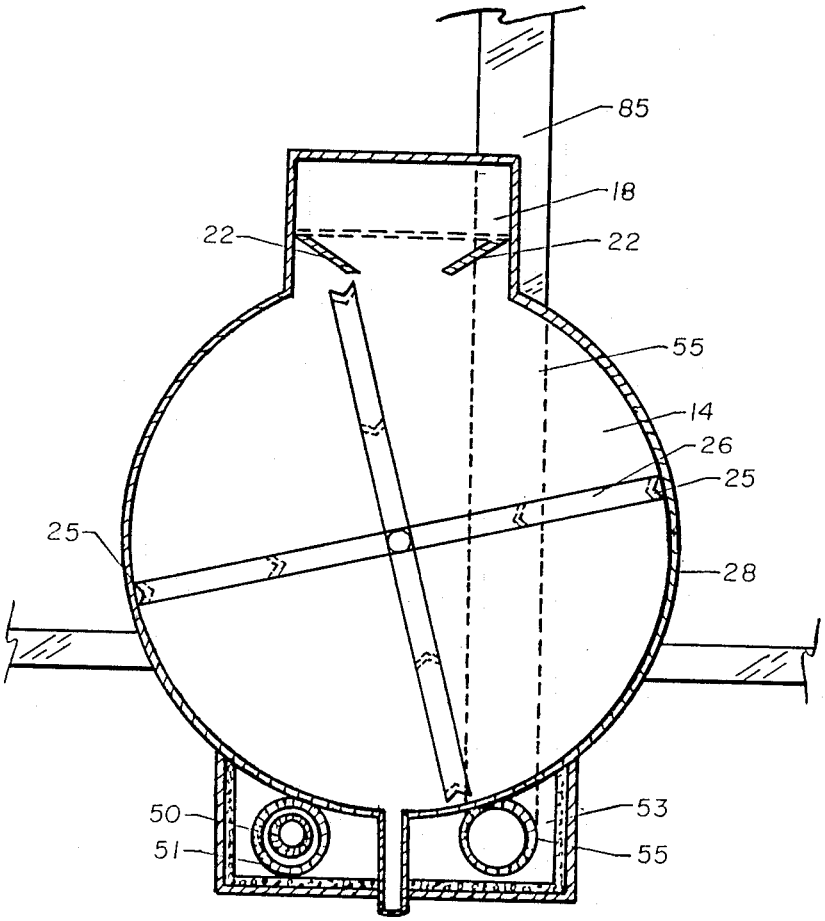
FIG. 3 is a cross section taken across the axis of the tank shown in FIG. 2.

More specifically, the tank 12 of the illustrated apparatus is divided into first 13 and second 14 chambers by means of an intermediate wall or barrier 8. This plate is the interior wall of chamber 13, with the opposing exterior wall 27 being formed as an end wall or plate for the tank 12. The outer tank wall 28 and an inner tank wall 29 define a annular enclosure for containing the water 30. This annular shape conforms to the cylindrical shape of the tank 12 which is more clearly shown in FIG. 3. The cylindrical configuration of the tank enables the rotating blades 25 to sweep the entire cavity or chamber 14 and maintain the slurry mixture 21 in uniform suspension.

The central opening 31 of the annular configuration houses approximately one-half of the rotating shaft 27. One end of this shaft is journaled in a bearing assembly 32 mounted on end wall 27. The other end of the shaft is journaled in a second bearing 33 which is mounted on the opposing end wall 7. This second shaft end 27 is coupled to a drive motor for providing rotational movement.

In this configuration, the shaft 27 falls generally along the central axis of the cylindrical body of the tank 12, being centrally disposed within the respective chambers 13 and 14. This coaxial orientation of the first and second chambers within a single tank provides significant advantages which will be apparent to those skilled in the art, based on the following description of the component operations of the system, including fluid transfer and drive control systems described hereafter.

This arrangement of chambers provides a source of heated water 30 conveniently ready for admixture into the second chamber 14 via water line 34. A description of this water line and coupled plumbing system is given in greater detail hereafter. The chamber also includes an overflow tube 35 having an open end 36 which permits release of excess pressure and water from within the chamber interior 13. The opposing end 37 provides for drainage of overflow water.

Figure 4:
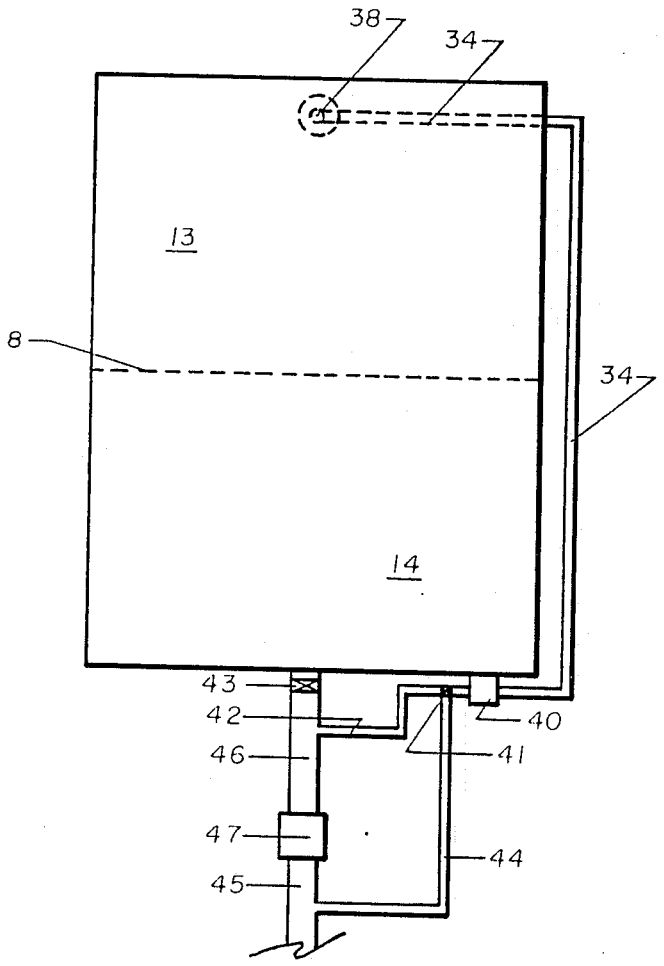
FIG. 4 is a block diagram of the water flow system utilized with the apparatus shown in the preceding Figures.

The actual plumbing and flow path of water extends from the outlet 38 (FIG. 4) along conduit 34 to a water pump 40 and adjacent three-way valve 41. The conduit then branches into a first flow line 42 used for delivery of water through a main valve 43 into the second chamber 14. Item 8 represents the boundary wall 25 shown in FIG. 2.

The second delivery line 44 provides a fluid path for delivery of water into a transport conduit 45, which also operates as the primary conduit for delivery of slurry from chamber 14. The purpose of this flow line is to provide means for cleaning the transport conduit 45 of residual slurry following operation of the apparatus. Hot water is pumped from the first chamber 13 through conduit 34 and into flow line 44. With the main valve 43 in the closed position, hot water then feeds through the transport conduit 45 and cleanses the conduit interior of the residual slurry. Alternatively, control valve 41 may be opened to pass water into an upper segment 46 of the transport conduit, to provide water flow through the main material pump 47 thereby cleansing any residual slurry therefrom.

Initially, water is delivered into the second chamber 14 through valve 43 in a heated condition. The disclosed fire box 15 provides heat not only for the first chamber 13 wherein water is raised to the temperature of between 110 degrees F. to 210 degrees F., and preferably at least 150 degrees F., but also heats the second chamber 14 which contains the slurry 21. This fire box includes a combustion heat source 50 which is supplied with propane or other fuel which can be burned, with the heat being exhausted through a port 51 into the fire box cavity 53. This heat circulates along the full length of the cavity 53 and supplies heat to brick material 54 or another appropriate heat sink source. An exhaust flue 55 enables venting of flue gas from the cavity 53 and extends through chamber 13 to thereby heat the contained water 30. Combusted air is vented through an attached chimney 56.

Because the subject slurry of water and tar sand is operable at temperatures below 210 degrees, the simple fire box arrangement of the present invention is satisfactory. The lower operating temperatures of this slurry are of considerable advantage over prior art systems requiring as much as twice the present operating temperature. It mainly avoids the need for a more expensive and complex heat source.

The present system operates with respect to both first and second chambers and provides ample heat to preheat the water 30 as well as supplying heat to the slurry contained within the chamber 14. In essence, this enables the operator to supply slurry material 21 for use in repair work, while a new supply of water 30 is being preheated for the next slurry preparation operation. Then the existing supply of slurry is exhausted, heated water is pumped into the second chamber 14, tar sand material is added through the hopper and the next batch of slurry is soon developed and ready for use. In this manner, the procedure is substantially continuous until the job is completed.

Figure 5:
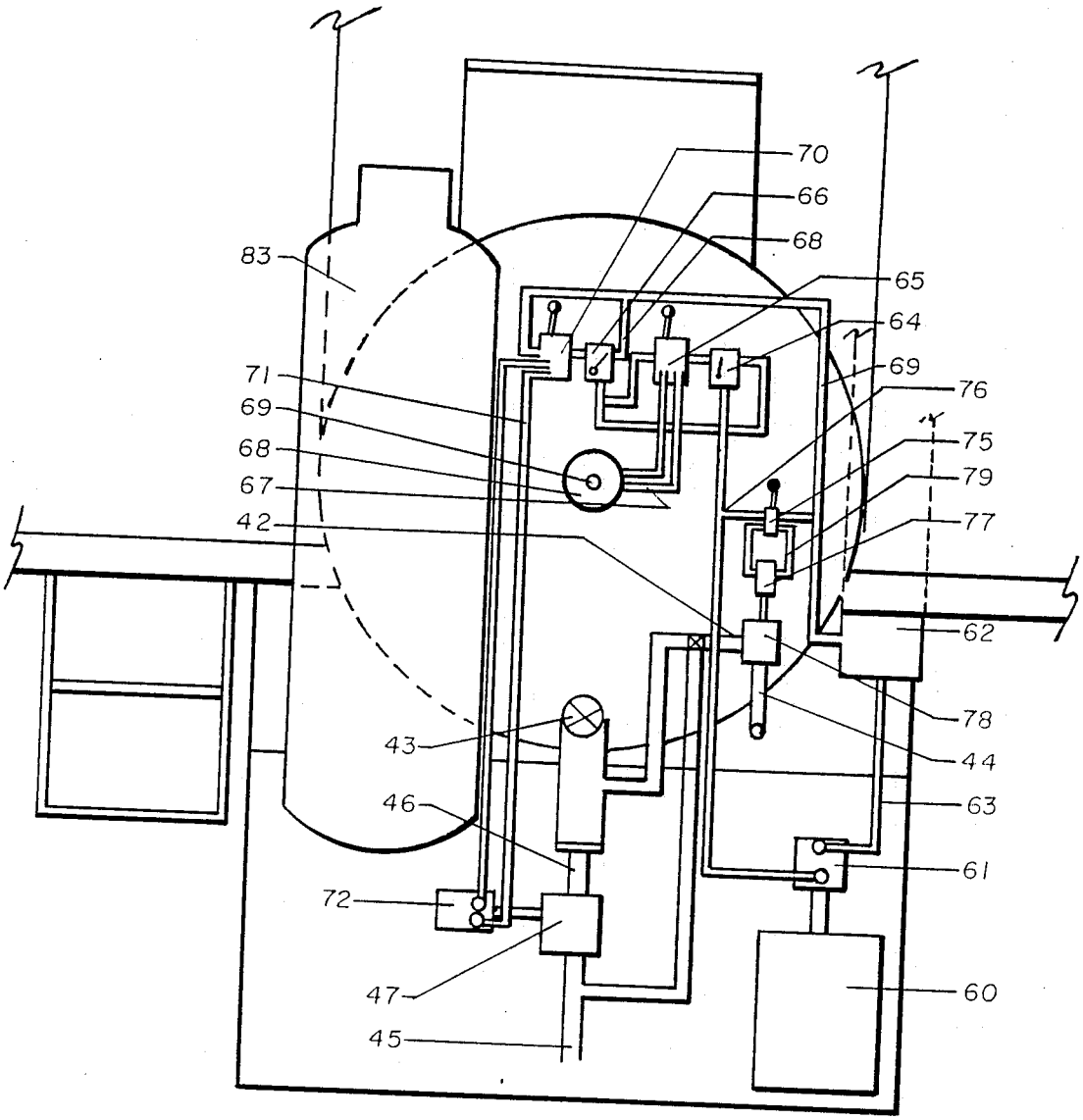
FIG. 5 is a graphic representation of the hydraulic fluid control system used in connection with the subject apparatus, including water, slurry composition and hydraulic flow lines and control valves.

Control of slurry preparation and discharge for application is enabled by a hydraulic drive system represented in FIG. 5, in combination with the water pumping system. Both water pumps and the main material pump are regulated by the hydraulic drive system as depicted. This drive system includes a power source 60 which consists of a Honda GX340, 11 horse power gasoline engine. This engine 60 drives the main hydraulic pump 61 which operates the pumps and flow lines hereafter described.

Hydraulic fluid flow originates from a primary storage tank 62 and is conducted to the main pump 61 via connecting conduit 63. From here, hydraulic flow extends to a primary flow control switch 64 which is coupled to the agitator and regulates rotational speed of the blades 25. This control switch provides a variable response to give rotational speeds from 1–60 rpm, the suggested range for rotation for this type of slurry mixture.

Hydraulic fluid then branches into two conduit segments, the left conduit feeding a flow direction regulator for providing agitator control in forward and reverse directions. The alternate branch conduit from the flow control switch 64 bypasses the hydraulic control switch 65 which enables selection of the forward and reverse rotation of the agitator, as well as an off control, and feeds directly to the material pump flow control switch 66. The closed circuit conduit extending along conduit 67 from the forward/reverse control 65 passes directly to the drive system 68 for the agitator shaft 69.

The hydraulic fluid path continues from the flow control switch 66 powering the material pump 47 through a branching conduit which is channeled on the right side 68 to a return conduit 69 feeding back to the storage tank 62. The alternate conduit from the left side of switch 66 passes to control 70 for the material pump. Conduit extends from this switch 70 to the circuit loop 71 communicating with the hydraulic motor drive 72 which powers material pump 47. This drive system enables delivery of prepared slurry material through the transport conduit 45 and 46 when the material valve 43 is open.

The water flow and pumping system is likewise controlled by the hydraulic drive system just described, and is set forth in FIG. 5 as well. This water flow system is activated by a water pump drive motor 77 which is coupled in the hydraulic line leading directly from the main hydraulic pump 61 at point 76. When switch 75 is open, hydraulic fluid passes into the flow circuit 79, driving the hydraulic motor 77 which powers water pump 78 coupled into the water flow line 44 (see FIG. 4). The flow of water within the subject apparatus has previously been discussed in connection with FIG. 4.

The disclosed apparatus permits practice of a method for filling or surfacing fissures, openings and cavities in the pavement surface which generally comprises the steps of:

a. placing a given volume of water within a container such as the first chamber 13 previously described;

b. heating the water to a temperature of at least 110 degrees F. but no more than 210 degrees F. and maintaining that temperature throughout the st<ps of this method;

c. securing a need<d quantity of bituminous sandstone;

d. mixing the water and bituminous sandstone in a ratio within the range of 20 to 56% water by Weight;

e. continuously agitating the combination of water and bituminous sandstone sufficiently to develop a uniform slurry having a consistency and viscosity which enables the slurry to substantially fill, conform and bond to the interior surface of the opening, yet which does not result in separation of the bitumen and the water into separate phases; and f. transporting and applying the prepared slurry to the opening for repair of the pavement.

As has been previously explained, this method is best practiced by utilizing a second chamber as the mixing chamber for the water and tar sand composite, and is best regulated at a temperature of 150–180 degrees F. The preferred range of water percentage is 24 to 30% by weight.

The second chamber 14 enables use of the additional procedures of transporting water from the first chamber to the second chamber and adding the bituminous sandstone therein, subject to constant agitation. Ideally, both chambers are subject to temperature control by means of a heating system such as the fire box disclosed at item 15 under the respective chambers 13 and 14.

The full cycle of use of the subject apparatus and method commences with introduction of water through the first chamber inlet 9, with the water being heated to at least 150 degrees F. by heat applied through the heat chamber 15. This water is transported to the second chamber and bituminous sandstone is added through the hopper 16. The agitating blades 25 are activated and a slurry of appropriate consistency is produced within the second chamber, with the temperature being maintained at the desired 110–210 degrees F. When the bituminous sandstone is converted to a slurry of uniform consistency and within the appropriate temperature range, the main material pump is activated and the slurry is transported through a conduit to the filling site on the damaged pavement. The subject slurry method has proved to be surprisingly well suited for pumping operation through a narrow conduit of less than one inch ID. The procedure continues until repair work is completed, and then the system is flushed by pumping hot water !rom the first chamber through the transport conduit. The respective first and second chambers are then emptied and the cleaning ports 80 and 81 are opened to remove any remaining debris from each chamber.

It should therefore be apparent that the subject apparatus is intended to be totally autonomous in its operation. Fuel is stored in a fuel tank 83, which is coupled in to the combustion section of the fire box. A raised section of the platform 84 conceals the fire box and portions of the fluid line system. A storage compartment 85 is provided for tools and other accessories useful in conducting the r®pair operation.

It will be apparent to those skilled in the art that the specific embodiments disclosed herein are merely exemplary of the inventive steps, apparatus and materials comtemplated within this disclosure. Accordingly, it is to be understood that such disclosure is by way of example and is not to be construed as limiting, beyond the specific restrictions defined in the following claims.

We claim:

1. Apparatus for preparing and applying a slurry of bitumen sandstone and water to a surface opening in paving material, comprising:

a mobile base having a top support surface;

a first enclosed chamber attached at the top surface for containing water;

a first chamber inlet;

a first chamber outlet including a valved fluid control means for controlling released fluid from the first chamber, said outlet being coupled to the first chamber for releasing heated water contained therein;

fluid heating means within the first chamber for heating water contents to a temperature greater than 150 Fahrenheit;

a second enclosed chamber attached to the top support surface for receiving bitumen sandstone and water to be mixed into a slurry composition;

fluid flow means coupled between and interconnecting the first and second chambers for transporting water from the first chamber outlet to the second chamber;

a second chamber opening for introducing the bitumen sandstone therein;

mixing means positioned within the second chamber for continuously agitating and liquefying the water-sandstone mixture into a slurry within the second chamber in a controlled manner.

2. An apparatus as defined in claim 1, wherein the first and second chambers are separate compartments within a single tank, separated by an intermediate wall therebetween.

3. An apparatus as defined in claim 2, wherein the tank comprises a cylindrical body having an end wall forming an enclosing side of the second chamber and wherein the agitating means comprises a plurality of rotating blades mounted with respect to a rotating shaft, said shaft being disposed centrally within the second chamber.

4. An apparatus as defined in claim 3, wherein the tank is formed as a cylindrical body, said first and second chambers being coaxially positioned in side-by-side relationship with a single, intermediate wall disposed therebetween.

5. An apparatus as defined in claim 4, wherein the first chamber is formed as an annular body with a central opening disposed along the cylindrical axis, said rotating shaft extending through said central opening and being journalled at one end to the end wall of the second chamber, the remaining end of the shaft being journalled in the opposing end of the tank which forms the end wall of the first chamber.

6. An apparatus as defined in claim 4, further comprising an overflow release positioned within the first chamber and having an exterior opening operable to permit outflow of excess water or pressure from the chamber interior.

7. An apparatus as defined in claim 1, wherein the first and second chambers are connected by a valved conduit which permits controlled delivery of water to the second chamber, said conduit being further coupled to the transport means by a second valve coupling which permits flow of water directly into the transport means for purposes of cleaning residue slurry from therein after use.

8. An apparatus as defined in claim 2, wherein the means for heating the water contents and second chamber comprises a firebox positioned below the tank below the first and second chambers, said firebox including (i) a combustion heat source, (ii) a firebox cavity with heat sink material, (iii) means for conducting heated air from the combustion source to the cavity and (iv) a flue passage for exhausting the heated air.

9. An apparatus as defined in claim 8, wherein the flue passage includes a terminal section which passes through a portion of the first chamber to thereby provide for additional heat to water contained therein.

10. An apparatus as defined in claim 1, wherein the second chamber includes a large opening and hopper compartment which includes a mesh screen barrier within the hopper for sizing the sandstone to small pieces and preventing foreign matter from falling within the second chamber.

11. An apparatus as defined in claim 1, further comprising pumping means for transporting the water and slurry within the apparatus, said pumping means being driven by a single hydraulic fluid drive system coupled to each pumping means, said pumping system including means for selectively activating the pumping means for transport or slurry transport.

12. An apparatus as defined in claim 11, wherein the hydraulic drive system further powers movement cf the agitator means and includes variable drive means for adjusting to varying rates of agitation.

13. An apparatus as defined in claim 1, further comprising cleanout ports at a base portion of the respective chambers for enabling removal of residual debris therefrom.

* * * * *